US008066625B2

(12) United States Patent
Scheiman

(10) Patent No.: US 8,066,625 B2
(45) Date of Patent: Nov. 29, 2011

(54) EXERCISE AID

(75) Inventor: Donald R. Scheiman, Sunnyvale, CA (US)

(73) Assignee: Scheiman Rebuild Fitness, Inc., Sunnyvale, CA (US)

( * ) Notice: Subject to any disclaimer, the term of this patent is extended or adjusted under 35 U.S.C. 154(b) by 585 days.

(21) Appl. No.: 11/817,666

(22) PCT Filed: Mar. 7, 2006

(86) PCT No.: PCT/US2006/008261

§ 371 (c)(1),
(2), (4) Date: Feb. 23, 2009

(87) PCT Pub. No.: WO2006/098986

PCT Pub. Date: Sep. 21, 2006

(65) Prior Publication Data

US 2011/0098162 A1 Apr. 28, 2011

Related U.S. Application Data

(60) Provisional application No. 60/661,124, filed on Mar. 10, 2005.

(51) Int. Cl.
*A63B 71/00* (2006.01)

(52) U.S. Cl. ..... 482/139; 602/19; 602/20

(58) Field of Classification Search ..... 482/139, 482/66–69; 128/873–875; 602/19
See application file for complete search history.

(56) References Cited

U.S. PATENT DOCUMENTS 1,707,441 A * 4/1929 Levinson ..... 2/90
3,901,229 A * 8/1975 Hensel et al. ..... 128/873
5,048,825 A 9/1991 Kelly
5,088,728 A * 2/1992 Deden ..... 482/139
5,188,587 A * 2/1993 McGuire et al. ..... 602/20
5,538,015 A * 7/1996 Paulson ..... 128/869
5,626,544 A 5/1997 Foresto
6,062,173 A 5/2000 Heinrichs
6,436,011 B1 * 8/2002 Cook ..... 482/69
7,559,443 B2 * 7/2009 Pratt et al. ..... 224/201
2006/0167395 A1 * 7/2006 Sawa ..... 602/19

OTHER PUBLICATIONS

"Client's Brainstorm sparks Trainer's Creativity," Idea Personal Trainer, 2003, p. 13.

Dupes, B. "What Would MacGyver Do?," inMotion, 2004, 14:3, p. 24-27.

Scheiman, D. R. "AE Amputation Exercises with the "Baker Rig"," as written for a class on Personal Training, 2003.

Scheiman, D. R. "The Baker Rig #201," as written for a class on Personal Training, 2003.

* cited by examiner

*Primary Examiner* — Glenn Richman
(74) *Attorney, Agent, or Firm* — Cooley LLP

(57) ABSTRACT

An exercise aid useful in allowing human subjects with amputations or other infirmities to use standard exercise equipment is described. In one embodiment, the exercise aid has a harness that securely encircles a shoulder of the subject and has a transverse wing that extends towards the other shoulder of the subject. The exercise aid has a sleeve, preferably adjustable, that fits securely around the upper arm and other shoulder of the subject and has an extension directed toward the transverse wing of the harness. The harness and sleeve may be detachably connected by a fastener. Exercise facilitating features, such as rings, are integrated into the sleeve of the exercise device for attachment to standard exercise equipment thus allowing human subjects with amputations or other infirmities the ability to engage in a full range of exercise options in order to prevent, or reverse, muscular atrophy associated with amputation.

34 Claims, 3 Drawing Sheets

EXERCISE AID

This application claims the benefit of priority to U.S. Provisional Patent Application Ser. No. 60/661,124, filed Mar. 10, 2005, incorporated by reference herein in its entirety.

FIELD OF THE INVENTION

This invention relates to exercise aids useful in allowing human subjects with amputations or other infirmities to use standard exercise equipment.

BACKGROUND OF THE INVENTION

In the United States, there are over 4 million individuals who have had an amputation of a limb. Worldwide, there is an estimated 10 million amputees. The amputations are attributable to disease, trauma/car accidents, birth defects, illnesses, and warfare. The majority of new amputations in the United States occur due to complications of the vascular system, especially from complications associated with diabetes. These types of amputations are known as dysvascular amputations. (Amputee Coalition of America: Amputation Statistics by Cause Limb Loss in the United States Revised 2005).

Amputees, especially those with amputations above the elbow, or "transhumeral" amputations, face an unique challenge in preventing muscular atrophy and associated bone density loss in the area surrounding the amputation. Currently available exercise options for transhumeral amputees are limited to isometric based modalities.

Therefore, the need exists to provide amputees, and other individuals with upper body or hand disabilities, the ability to engage in a full range of exercise options in order to prevent, or reverse, muscular atrophy associated with amputation.

SUMMARY OF THE INVENTION

In accordance with the above objectives, the present invention provides an exercise aid device for a human subject. One aspect of this invention provides for an exercise aid that comprises a harness that securely encircles a shoulder of the subject, wherein the harness has a transverse wing that extends towards the other shoulder of the subject and that is positionable at the upper back of the subject. The harness is in combination with a sleeve that fits securely around the upper arm and other shoulder of the subject, wherein the sleeve, when positioned about the other shoulder of the subject, has an extension that is directed toward the transverse wing of the harness and is positionable at the upper back of the subject. A fastener detachably connects the transverse wing of the harness to the extension of the sleeve.

Another aspect of the invention provides for an exercise aid for a human subject comprising a harness that securely encircles a shoulder of the subject, wherein the harness has a transverse wing that extends towards the other shoulder of the subject and that is positionable at the upper back of the subject and wherein the harness comprises a connector for adjustment to the size of the subject's shoulder. The harness is in combination with a sleeve that fits securely around the upper arm and other shoulder of the subject, wherein the sleeve, when positioned about the other shoulder of the subject, has an extension that is directed toward the transverse wing of the harness and is positionable at the upper back of the subject. The transverse wing of the harness is connected to the extension of the sleeve. In a preferred embodiment, the transverse wing of the harness is detachably connected to the extension by a fastener.

Yet another aspect of the invention provides for an exercise aid for a human subject comprising a harness that securely encircles a shoulder of the subject, wherein the harness has a transverse wing that extends towards the other shoulder of the subject and that is positionable at the upper back of the subject. The harness is in combination, with a sleeve that fits securely around the upper arm and other shoulder of the subject, wherein the sleeve, when positioned about the other shoulder of the subject, has an extension that is directed toward the transverse wing of the harness and is positionable at the upper back of the subject. The transverse wing of the harness is connected to the extension of the sleeve and the internal dimension of the sleeve is adjustable for a secure fit around the upper arm. In a preferred embodiment, the transverse wing of the harness is detachably connected to the extension by a fastener.

BRIEF DESCRIPTION OF THE DRAWINGS

The invention is more fully appreciated in connection with the following detailed description taken in conjunction with the accompanying figures, in which.

DETAILED DESCRIPTION OF THE INVENTION

Figure 1:
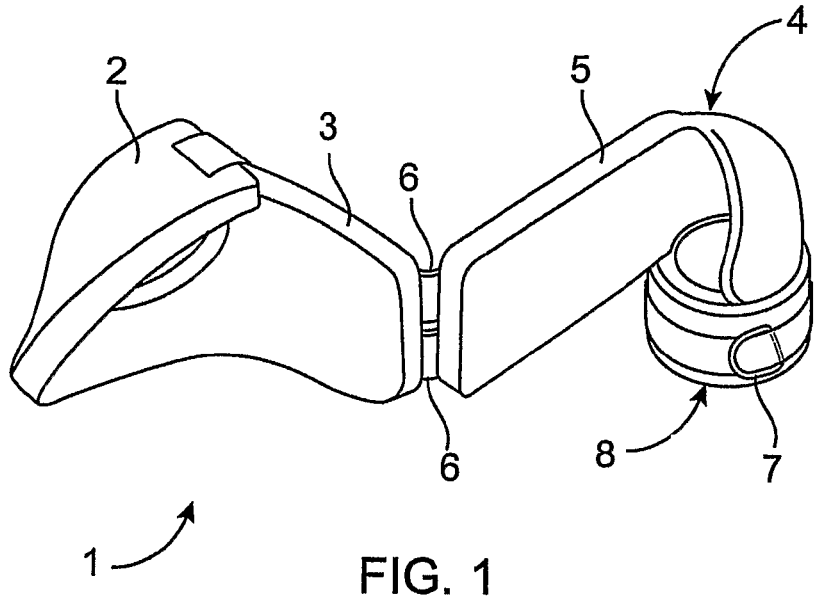
FIG. 1 is a perspective view of the exercise aid, viewed more or less from the front of the aid, illustrating that the aid includes a harness that is adjustably connected to a sleeve by VELCRO® straps.

The exercise aid is designed to assist a human subject with an upper body or hand ailment, injury, disability or birth defect in exercising the upper body muscles. Specifically, the exercise aid was created for use by subjects with upper arm amputations, who were, until now, unable to utilize most standard exercise equipment designed for the muscle groups of the upper body. In addition to aiding upper arm amputees, the aid is useful for subjects having a variety of infirmities, including but not limited to arthritis in the hands (preventing grasping of exercise equipment), tendonitis in the elbow, congenital birth defects, subjects born with malformed or no hands, stroke victims, and subjects with fractured hand or forearm.

Without the use of the exercise aid, subjects with amputations, or other infirmities, are limited to isometric based exercise modalities. Use of the exercise aid allows the subject to obtain a level of fitness not previously attainable due to the subject's amputation or other infirmity. Benefits obtained through use of the exercise aid include increased muscle tone and strength and a decrease in the loss of bone density.

In one embodiment, the exercise aid comprises a harness that securely encircles a shoulder of the subject and has a transverse wing that extends towards the other shoulder of the subject and that is positionable at the upper back of the subject. The exercise aid further comprises a sleeve that fits securely around the upper arm, or stump in the case of an amputee, and other shoulder of the subject. When positioned about the other shoulder of the subject, the sleeve has an extension that is directed toward the transverse wing of the harness and is positionable at the upper back of the subject. The harness and sleeve may be either continuously connected and comprise a continuous piece of neoprene material to form the exercise aid or detachably connected by a fastener, as discussed hereinafter.

In a preferred embodiment, the transverse wing of the harness is detachably connected to the extension of the sleeve by a fastener. The fastener connects the transverse wing to the extension using at least one hook and loop strap, button, buckle, brace, belt, clamp, clasp, hook, rivet, or zipper. In a preferred embodiment, the fastener uses at least one hook and loop strap to detachably connect the transverse wing to the extension. A "hook and loop" strap is a fabric fastener comprised of a soft fuzzy (loop) component and a rougher (hook) component. When the components are pushed together, hundreds of tiny hooks engage the loops to form a strong, but detachable, connection. Preferably, the hook and loop fastener is a VELCRO® brand hook and loop strap. In a preferred embodiment, the fastener is at least one VELCRO® strap which connects to a gripable covering of the transverse wing and the extension. In a more preferable embodiment, the fastener is two VELCRO® straps which connect to a gripable covering of the transverse wing and the extension. The gripable covering is, for example, VELCRO® or other material capable of forming a hook and loop connection with the hook and loop strap, for example a neoprene material or UBL (unbreakable loop) material.

The fastener provides the exercise aid the ability to adjust to fit a variety of different sized human subject by allowing the exercise aid to conform to the distance between the shoulders of such subjects. Additionally, the fastener provides subjects with an option to mix and match different harnesses and sleeves together to form a unique exercise aid.

The harness, when connected to the sleeve, provides stability and prevents movement and unintended removal of the end of the sleeve off the arm or stump during exercise. At rest, the harness, when connected to the sleeve, maintains the end of the sleeve in a stationary position on the subject's arm or stump.

In a preferred embodiment, the sleeve has at least one exercise facilitating fixture integrated into the outside of the sleeve. The exercise facilitating fixture allows for the exercise aid to be adapted for use with exercise equipment. For example, the exercise facilitating fixture allows for the sleeve of the exercise aid to be connected to standard exercise equipment typically found in a gymnasium, such as a lat angled or pull down machine or any other weight or pulley-based exercise equipment. In one embodiment, the exercise facilitating fixture comprises a ring integrated into the outside of the end of the sleeve. The ring allows for detachable connection of the sleeve to exercise equipment. In a further embodiment, the exercise facilitating fixture comprises two rings integrated into the outside of the end of the sleeve, each ring being positioned about 180° from the other. This position of the rings allows the subject to use exercise equipment using forward, backward, and lateral movements.

In some embodiments, the internal dimension of the sleeve is adjustable for a secure fit around the upper arm, or humerus. In a preferred embodiment, the internal dimension of the sleeve is adjustable around the subject's upper arm using at least one concentric cylinder removably attached to the inside of the sleeve. In a further preferred embodiment, the internal dimension of the sleeve is adjustable around the subject's upper arm using a series of concentric cylinders removably attached to the inside of the sleeve. Removable concentric cylinders enable the internal dimension of the sleeve to be securely positioned around the stump or upper arm to prevent abrasion and provide stability during exercise.

In further embodiments, the harness comprises a connector that allows for adjustment to the size of the subject's shoulder. The connector, in a preferred embodiment, is a VELCRO® strap, which connects two edges of the harness together and enables the subject an adjustability that is desirable due to weight gain or clothing changes and also allows for use of the exercise aid by a variety of different sized subjects.

The harness, sleeve and removable concentric cylinders are made from a flexible and firm foam material that is about ¼ inch to about 1 inch in thickness. In a preferred embodiment, the material is made from two layers of a neoprene wetsuit material that is singularly approximately 9 millimeters in thickness. The two layers together give the harness and sleeve a thickness of approximately 18 millimeters or about ¾ inch thick. The two layers of neoprene wetsuit material are affixed together, e.g., via an epoxy or other appropriately binding material. In a more preferred embodiment, the material is a single neoprene wetsuit material that is approximately 12 millimeters in thickness. Preferably, the outer covering of the neoprene wetsuit material has a gripable covering material that enables the VELCRO® straps to connect to harness and sleeve.

The exercise aid can be constructed using any suitable method. In one method, construction of the exercise aid begins by creating a template to fit the dimensions of the subject. A spherical object with the similar dimensions as the intended subject's shoulder is used to construct the template for the sleeve. A triangular piece of the spherical object is cut out to form the basis of a template. The triangular piece is flattened and a piece of plastic, approximately 1/16 inch thick, is placed on top of the triangular piece cut from the spherical object. With a writing device, the shape of the triangular piece is traced onto the plastic. The plastic is cut in the shape traced to form the template. This template is placed on the previously described neoprene material and the pattern is traced onto it accordingly. Once the neoprene material is cut in the pattern of the sleeve template, the extension, concentric cylinders and harness pieces are cut out of the neoprene wetsuit. If two pieces of neoprene material are used in the construction of the exercise aid, the pieces are affixed together using an epoxy. After assembly of the exercise aid, the exercise facilitating fixture or fixtures, the fastener that detachable connects the transverse wing of the harness to the extension of the sleeve, and/or the connector that allows for adjustment of the shoulder of the harness are added according to the subject's desires.

The exercise aid is further described with reference to the figures.

FIG. 1 is a front perspective of the exercise aid 1, comprising a harness 2 and sleeve 4. The harness 2 has a transverse wing 3 that is connected to the extension 5 of sleeve 4 by a fastener 6. The fastener 6 in this embodiment is two VELCRO® straps, which adhere to the transverse wing 3 and extension 5 by a gripable covering on the neoprene wetsuit material. Also visible in this drawing are the end of sleeve 8 and an exercise facilitating fixture shown as ring 7.

Figure 2:
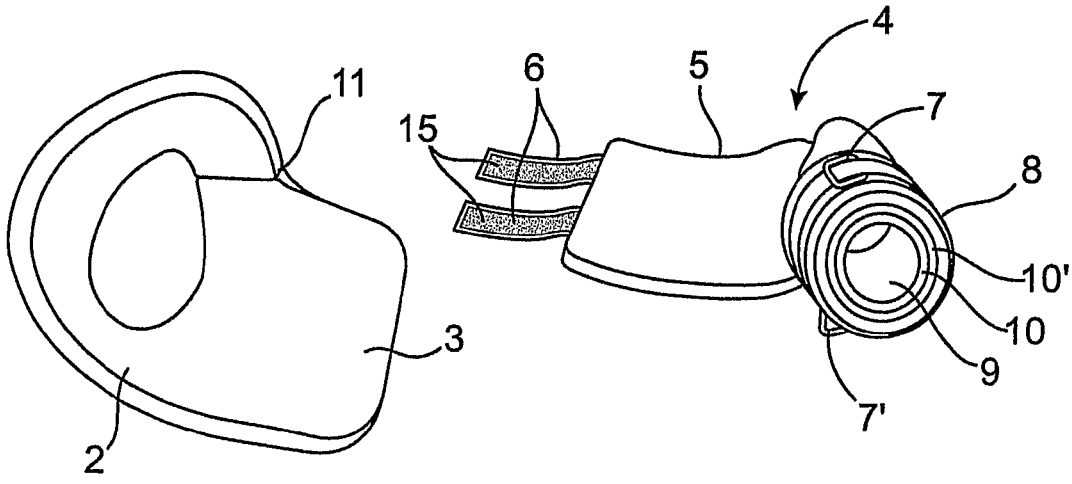
FIG. 2 is a perspective view of the harness detached from the sleeve, viewed more or less from the bottom of the aid.

FIG. 2 is a perspective of the harness 2 completely detached from the sleeve 4. The harness 2 is positioned to clearly view the transverse wing 3 and slit 11, which creates an opening in the shoulder of harness 2 to allow for adjustment of the harness to the size of the subject's shoulder. The position of the sleeve 4 enables a view of the internal dimension 9, which is adjustable to fit the subject's upper arm or stump by concentric cylinders 10 and 10'. Also visible in this depiction are the end of the sleeve 8 and two rings 7 and 7' positioned 180° from each other. The sleeve 4 has a fastener 6, which is two VELCRO® straps detachably connected to the extension 5 by hooks on the surface 15 of the fastener 6 to the gripable covering on the neoprene wetsuit material.

Figure 3:
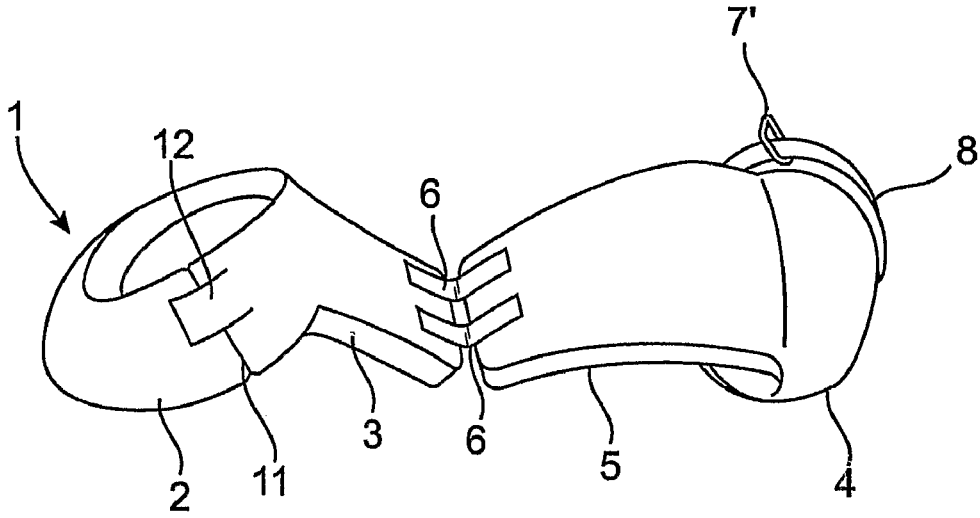
FIG. 3 is a perspective view of the exercise aid further demonstrating that the harness and the sleeve of the exercise aid are adjustably connected by two VELCRO® straps.

FIG. 3 is a side perspective of exercise aid 1, in a position to view the fastener 6 that in this drawing is two VELCRO® straps that attach to the extension 5 and the transverse wing 3. Also visible in this drawing is the slit 11, joined here by a connector 12, which in this embodiment is a VELCRO® strap. In this view, ring 7' attached to the end of sleeve 8 of the sleeve 4 is visible.

Figure 4:
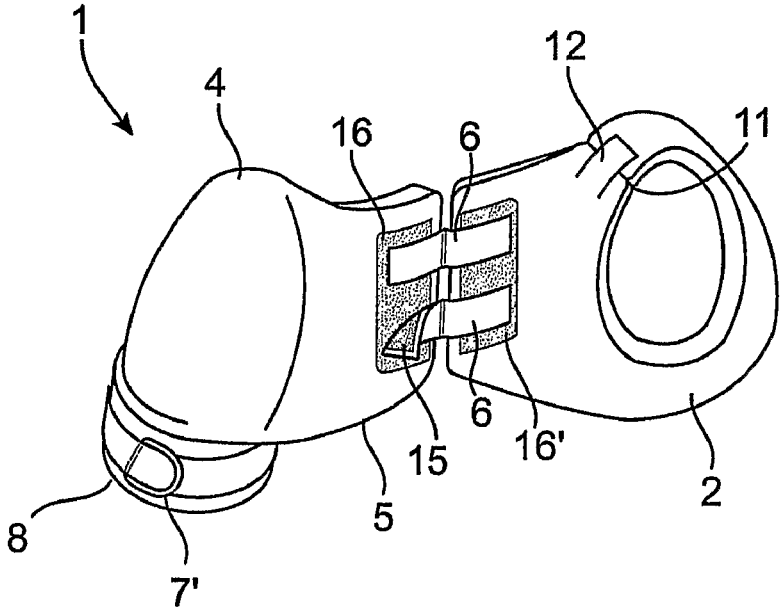
FIG. 4 is a perspective view of the exercise aid, viewed more or less from the back of the aid, demonstrating that the harness has a connector that allows for adjustment to the size of the subject's shoulder.

FIG. 4 is a rear depiction of the exercise aid 1 illustrating the harness 2 with a connector 12, which in this embodiment is a VELCRO® strap, joining slit 11, to adjustably fit shoulders of varying sizes to fit the harness. Further, depicted is the fastener 6, which in this embodiment is two VELCRO® straps connecting the harness 2 and sleeve 4 using the connection between the hooks on the surface 15 of the fastener 6 and the gripable covering on the neoprene wetsuit material 16 and 16'. Also present in the drawing is ring 7'.

Figure 5:
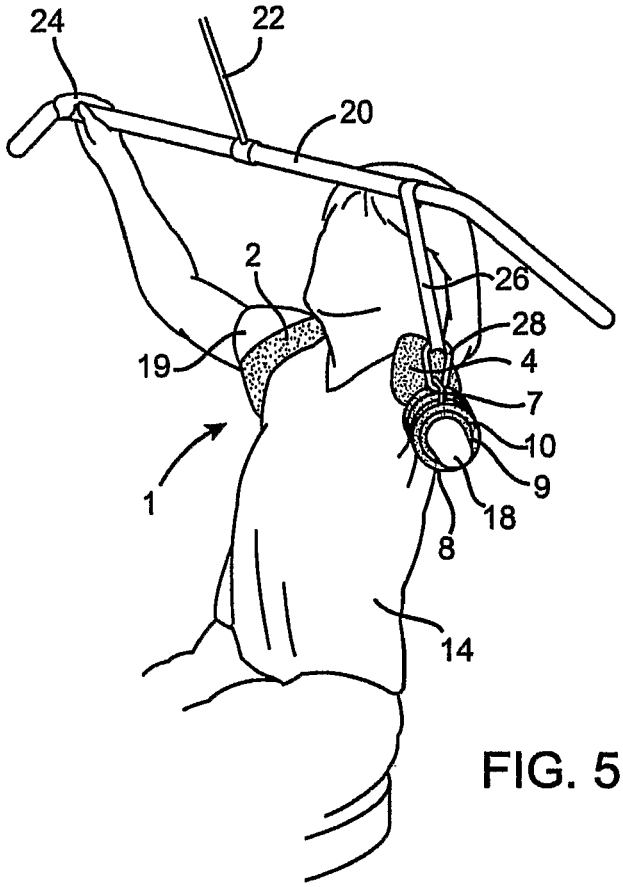
FIG. 5 is a depiction of a human subject using the exercise aid to exercise.

FIG. 5 is a depiction of a human subject 14 using the exercise aid 1 to perform exercise on a standard piece of exercise equipment. In the depiction, the piece of exercise equipment is a "lat" machine which simultaneously exercises the subject's right and left latissimus dorsi muscles and other associated muscles when bar 20 is pulled downward against resistance provided by a cable, chain, or rod 22 and the remainder of the machine (not shown). The subject 14 has a transhumeral amputation of the left arm 18. The exercise aid 1 is worn by the subject 14 so that the harness 2 securely encircles the subject's right shoulder 19 and the sleeve 4 fits securely around the left upper arm and shoulder of the subject. The internal dimension of the sleeve 9 is adjusted using a concentric cylinder 10 to fit securely around the left upper arm 18 of the subject 14. The sleeve 4 is connected to exercise equipment by attachment of the ring 7 to a clamp 28 that is attached to an extension arm 26 that is attached to an exercise bar 20. To perform the exercise, the subject 14 grasps the exercise bar 20 with the right hand 24 and pulls the exercise bar down using both the right hand and the left upper arm thus allowing the subject to simultaneously exercise both the right and left shoulder, back, and/or arm area.

Figure 6:
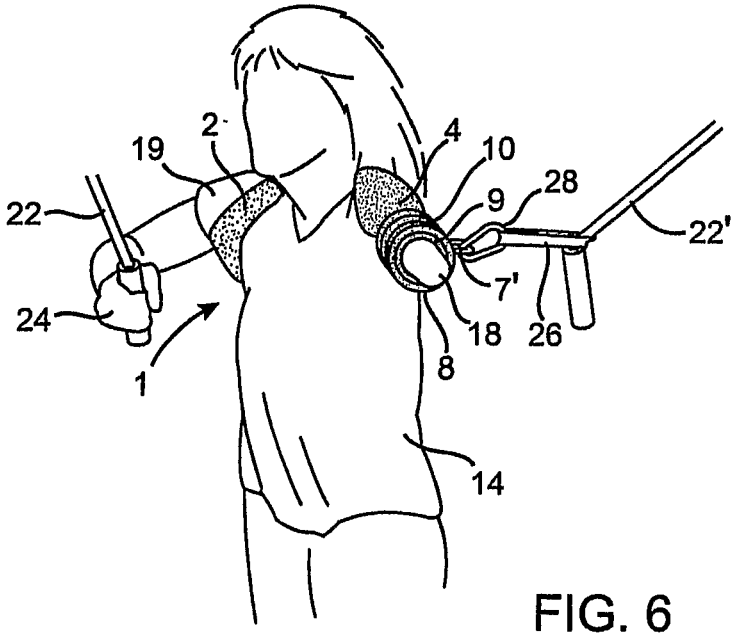
FIG. 6 is a further depiction of a human subject using the exercise aid to exercise.

FIG. 6 is a further depiction of a human subject using the exercise aid to perform exercise on another standard piece of exercise equipment. In the depiction, the exercise equipment is a "pec" machine in which the right and left pectoral muscles and other associated muscles are simultaneously exercised when rod 22 and extension arm 26 are moved forward against resistance provided by the remainder of the machine (not shown). The subject 14 has a transhumeral amputation of the left arm 18. The exercise aid 1 is worn by the subject 14 so that the harness 2 securely encircles the subject's right shoulder 19 and the sleeve 4 fits securely around the left upper arm and shoulder of the subject. The internal dimension of the sleeve 9 is adjusted using a concentric cylinder 10 to fit securely around the left upper arm 18 of the subject 14. The sleeve 4 is connected to exercise equipment by attachment of the ring 7' to a clamp 28 that is attached to an extension arm 26 that is connected to rod 22' of the exercise equipment. To perform the exercise, the subject 14 grasps bar 22 with the right hand 24 and pushes it forward and simultaneously pulls the extension arm 26 using the left upper arm 18 that is attached to it by the exercise aid 1 by way of sleeve 4 and ring 7'. thus allowing the subject to simultaneously exercise both the right and left shoulder, chest, and/or arm area.

Described and illustrated herein are several embodiments of an exercise device. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as so claimed.

I claim:

1. An exercise aid for a human subject having a transhumeral amputation, the aid comprising:

a harness that securely encircles a shoulder of the subject, wherein the harness has a transverse wing that extends from one shoulder towards the subject's other shoulder attached to the arm having the transhumeral amputation and that is positionable at the upper back of the subject;

a sleeve that fits securely around the upper arm and other shoulder of the subject, wherein the sleeve, when positioned about the subject's other shoulder and arm having the transhumeral amputation, has an extension that is directed toward the transverse wing of the harness and is positionable at the upper back of the subject while allowing the subject to raise both arms away from the body to exercise; and a fastener that detachably connects the transverse wing of the harness to the extension of the sleeve.

2. The exercise aid of claim 1, wherein the fastener connects the transverse wing to the extension using at least one hook and loop strap, button, buckle, brace, belt, clamp, clasp, hook, rivet, or zipper.

3. The exercise aid of claim 2, wherein the fastener is at least one VELCRO® strap.

4. The exercise aid of claim 1, wherein the exercise aid is adjustable to fit a variety of different sized human subjects to conform to the distance of between the shoulders of the subjects.

5. The exercise aid of claim 1, wherein the sleeve has at least one exercise facilitating fixture integrated into the outside of the sleeve.

6. The exercise aid of claim 5, wherein the exercise facilitating fixture comprises a ring integrated into the outside of the end of the sleeve, for detachable connection of the sleeve to exercise equipment.

7. The exercise aid of claim 5, wherein the exercise facilitating fixture comprises two rings integrated into the outside of the end of the sleeve, each ring being positioned about 180° from the other.

8. The exercise aid of claim 1, wherein the internal dimension of the sleeve is adjustable for a secure fit around the upper arm.

9. The exercise aid of claim 8, wherein the internal dimension of the sleeve is adjustable around the subject's upper arm using at least one concentric cylinder removably attached to the inside of the sleeve.

10. The exercise aid of claim 1, wherein the harness comprises a connector that allows for adjustment to the size of the subject's shoulder.

11. The exercise aid of claim 1, wherein the harness and the sleeve each comprise flexible and firm foam material.

12. The exercise aid of claim 11, wherein the material is up to about 1 inch thick.

13. An exercise aid for a human subject having a transhumeral amputation, which aid comprises a harness that securely encircles a shoulder of the subject, wherein the harness has a transverse wing that extends towards the subject's other shoulder attached to the arm having the transhumeral amputation and that is positionable at the upper back of the subject and wherein the harness comprises a connector for adjustment to the size of the subject's shoulder;

sleeve that fits securely around the upper arm having the transhumeral amputation and other shoulder of the subject, wherein the sleeve, when positioned about the other shoulder of the subject, has an extension that is directed toward the transverse wing of the harness and is positionable at the upper back of the subject while allowing the subject to raise both arms away from the body to exercise; and wherein the transverse wing of the harness is connected to the extension of the sleeve.

14. The exercise aid of claim 13, wherein a fastener detachably connects the transverse wing to the extension.

15. The exercise aid of claim 14, wherein the fastener connects the transverse wing to the extension using at least one hook and loop strap, button, buckle, brace, belt, clamp, clasp, hook, rivet, or zipper.

16. The exercise aid of claim 15, wherein the fastener is at least one VELCRO® strap.

17. The exercise aid of claim 13, wherein the exercise aid is adjustable to fit a variety of different sized human subjects to conform to the distance of between the shoulders of the subjects.

18. The exercise aid of claim 13, wherein the sleeve has at least one exercise facilitating fixture integrated into the outside of the sleeve.

19. The exercise aid of claim 18, wherein the exercise facilitating fixture comprises a ring integrated into the outside of the end of the sleeve, for detachable connection of the sleeve to exercise equipment.

20. The exercise aid of claim 18, wherein the exercise facilitating fixture comprises two rings integrated into the outside of the end of the sleeve, each ring being positioned about 180° from the other.

21. The exercise aid of claim 13, wherein the internal dimension of the sleeve is adjustable for a secure fit around the upper arm.

22. The exercise aid of claim 21, wherein the internal dimension of the sleeve is adjustable around the subject's upper arm using at least one concentric cylinder removably attached to the inside of the sleeve.

23. The exercise aid of claim 13, wherein the harness and the sleeve each comprise flexible and firm foam material.

24. An exercise aid for a human subject having a transhumeral amputation, which aid comprises a harness that securely encircles a shoulder of the subject, wherein the harness has a transverse wing that extends towards the subject's other shoulder attached to the arm having the transhumeral amputation and that is positionable at the upper back of the subject;

a sleeve that fits securely around the upper arm having the transhumeral amputation and other shoulder of the subject, wherein the sleeve, when positioned about the other shoulder of the subject, has an extension that is directed toward the transverse wing of the harness and is positionable at the upper back of the subject while allowing the subject to raise both arms away from the body to exercise; and wherein the transverse wing of the harness is connected to the extension of the sleeve and the internal dimension of the sleeve is adjustable for a secure fit around the upper arm.

25. The exercise aid of claim 24, wherein a fastener detachably connects the transverse wing to the extension.

26. The exercise of claim 25, wherein the fastener connects the transverse wing to the extension using at least one hook and loop strap, button, buckle, brace, belt, clamp, clasp, hook, rivet, or zipper.

27. The exercise aid of claim 26, wherein the fastener is at least one VELCRO® strap.

28. The exercise aid of claim 24, wherein the exercise aid is adjustable to fit a variety of different sized human subjects to conform to the distance of between the shoulders of the subjects.

29. The exercise aid of claim 24, wherein the sleeve has at least one exercise facilitating fixture integrated into the outside of the sleeve.

30. The exercise aid of claim 29, wherein the exercise facilitating fixture comprises a ring integrated into the outside of the end of the sleeve, for detachable connection of the sleeve to exercise equipment.

31. The exercise aid of claim 29, wherein the exercise facilitating fixture comprises two rings integrated into the outside of the end of the sleeve, each ring being positioned about 180° from the other.

32. The exercise aid of claim 24, wherein the internal dimension of the sleeve is adjustable around the subject's upper arm using at least one concentric cylinder removably attached to the inside of the sleeve.

33. The exercise aid of claim 24, wherein the harness comprises a connector that allows for adjustment to the size of the subject's shoulder.

34. The exercise aid of claim 24, wherein the harness and the sleeve each comprise flexible and firm foam material.

* * * * *